US007191800B2

(12) United States Patent
Berner et al.

(10) Patent No.: US 7,191,800 B2
(45) Date of Patent: Mar. 20, 2007

(54) FLUIDIC CONTROL SYSTEM

(75) Inventors: Michael Berner, Kirchheim (DE); Grzegorz Bogdanowicz, Ostfildern (DE)

(73) Assignee: Festo AG & Co., Esslingen (DE)

( * ) Notice: Subject to any disclaimer, the term of this patent is extended or adjusted under 35 U.S.C. 154(b) by 29 days.

(21) Appl. No.: 10/534,443

(22) PCT Filed: Nov. 21, 2003

(86) PCT No.: PCT/EP03/13061

§ 371 (c)(1),
(2), (4) Date: May 10, 2005

(87) PCT Pub. No.: WO2004/055387

PCT Pub. Date: Jul. 1, 2004

(65) Prior Publication Data

US 2006/0011240 A1 Jan. 19, 2006

(30) Foreign Application Priority Data

Dec. 17, 2002 (DE) ..... 202 19 497 U

(51) Int. Cl.
*F16K 11/22* (2006.01)

(52) U.S. Cl. ..... 137/884; 137/553

(58) Field of Classification Search ..... 137/269, 137/271, 884, 553, 554, 555
See application file for complete search history.

(56) References Cited

U.S. PATENT DOCUMENTS

| | | | | |
|---|---|---|---|---|
| 5,106,169 | A * | 4/1992 | Barefoot | 303/22.7 |
| 5,950,661 | A * | 9/1999 | Kirchhoff-Stewens | 137/269 |
| 6,065,494 | A * | 5/2000 | Thomsen et al. | 137/552 |
| 6,213,153 | B1 * | 4/2001 | Hayashi et al. | 137/884 |

FOREIGN PATENT DOCUMENTS

| | | | |
|---|---|---|---|
| DE | 19711227 | C2 | 9/1998 |
| DE | 29909529 | U1 | 9/1999 |
| DE | 19916839 | C1 | 10/2000 |
| DE | 10115913 | A1 | 10/2002 |
| DE | 10216703 | A1 | 11/2002 |
| EP | 1041325 | A2 | 10/2000 |
| EP | 1184611 | A2 | 3/2002 |

* cited by examiner

*Primary Examiner*—John Fox
(74) *Attorney, Agent, or Firm*—Hoffman & Baron, LLP

(57) ABSTRACT

A fluid power controller device comprises a plurality of valve modules arranged sequentially in a row direction and collected together as an array-like unit, such modules comprising respectively a principal valve having at least one moving valve member and at least one electrically operated valve drive for the principal valve. At least two of the valve modules placed sequentially in the row direction are spaced from each other with the formation of an intermediate space. In such intermediate space a diagnostic module is placed for the detection of at least one operational state of one or both principal valves.

18 Claims, 2 Drawing Sheets

FLUIDIC CONTROL SYSTEM

This application is a National Phase application of International Application No. PCT/EP2003/013061, filed Nov. 21, 2003, which claims priority based on German patent Application No. 202 19 497.3, filed Dec. 17, 2002, which are incorporated herein by reference.

FIELD OF THE INVENTION

The invention relates to a fluid power controller device comprising valve modules arranged in sequence in a row direction and collected together as an array-like unit, such modules each including a principal valve fitted with at least one moving valve member and at least one electrically operated valve drive for the principal valve.

BACKGROUND OF THE INVENTION

The German patent publication 29,909,529 U1 discloses various forms of such a controller device, several valve modules being collected together in each case to constitute an array-like unit and such unit being either designed to be self-supporting or being placed on a plate-like module carrier. The valve modules each comprise a principal valve serving for the control of a principal valve subject to positive or negative pressure medium pressure and at least one electrically operated valve drive serving for the operation of the principal valve.

If the controller devices are employed in complex machines there is a need for a precise monitoring of the operational state of the principal valves. Such monitoring has so far been performed visually using optical inspection means, which indicate the switching state of the valve drive. It would also be feasible to detect the switching state of the valve drives electrically, for example on the basis of amperage measurement. In all cases there is however the disadvantage that from the switching state of the valve drive no conclusions may be drawn about the operational state of the principal valve. Owing to trouble conditions for example the switching over of the principal valve may be prevented, although the valve drive has been activated.

SUMMARY OF THE INVENTION

Accordingly one object of the present invention is to propose measures which render possible a more precise monitoring of the state of the principal valves of a fluid power controller device.

In order to achieve this object in the case of a fluid power controller device of the type initially mentioned there is the provision that at least two valve modules placed in sequence in the row direction are spaced apart with the formation of an intermediate space, a diagnostic module being placed in the intermediate space for the detection of at least one operational state of one or both of the adjacent principal valves.

It is in this manner that while maintaining compact dimensions of the valve modules a precise detection of the operational condition of one or more principal valves is possible. At least the majority of the measures necessary for such detection is implemented in the diagnostic module, whereas on the principal valve itself no or only a few design changes are necessary departing from a conventional design. Accordingly the principal valve may be usually operated selectively in connection with a diagnostic module or without one, something which renders possible an extremely simple adaptable arrangement of fluid power controller devices. Owing to the placement of the diagnostic module or modules between adjacent valve modules there is a direct proximity to the state information, which is to be detected, this leading to a high of precision. Since the valve modules collected together as array-like units are frequently basically arranged at a small distance apart, the diagnosis may be implemented without any extreme enlargement of the overall dimensions of the controller device. In any case by detecting at least one operational state of the principal valve or valves highly precise state monitoring may be performed, something favoring an integration in an electronic control system.

There is in principle the possibility of arranging a respective diagnostic module between all sequentially placed valve modules. In such a case each diagnostic module will be designed for dealing with the operational data of only one principal valve. However, there is also the advantageous possibility of so designing the diagnostic module that it may detect the operational state of both principal valves flanking it. Accordingly the number of the diagnostic modules to be employed may be reduced.

Leaving aside possibly the longitudinal dimensions in the row direction there is no increase in the dimensions of the controller device, if the diagnostic modules have such dimensions that they are within the outline of the adjacent valve modules.

The output signals of the diagnostic modules are conveniently transmitted by way of an electrical concatenation means, with which the valve modules and, respectively, their valve drives, are connected. The internal wiring is not then made more complex or is only slightly increased in complexity.

The use of the diagnostic modules is inter alia possible in the case of such controller devices, in which the array-like unit comprising the valve modules has at least one fluid duct extending through it, which is made up of aligned through ducts of the individual valve modules. In this case diagnostic modules are utilized, which possess corresponding through ducts so that the desired fluid duct is still present, more particularly for the central supply and/or removal of the pressure medium.

It is possible to do without such through ducts in the diagnostic module, if the valve modules are not directly connected together for fluid transmission, but are jointly mounted on a plate-like module support, which performs the function of fluid power concatenation between the individual valve modules. In this case as well however the diagnostic modules are preferably integrated in the already present electrical concatenation means of the valve modules.

The diagnostic modules preferably possess a flat configuration and are more particularly disk-like or plate-like in form. They are placed between adjacent valve modules so that their plane of extent runs at a right angle to the row direction.

The diagnostic modules present are preferably provided with suitable sensor means, which detect the desired operational state of the adjacent principal valve or valves and produce the corresponding output signals. Such sensor signals may be directly supplied to central electronic control circuitry which is placed on board the controller device or is placed externally, or however be supplied in the form of processed diagnostic signals, for which purpose a respective diagnostic module may have its own evaluating electronic circuitry.

Certain states of a principal valve, for example the switching position of the valve member, may be detected, using suitable sensor means, without any direct access to the internal space of the respective principal valve. This applies for example for contact-less interrogation of the switching position, more particularly using inductive proximity sensors. If however for example an optical monitoring of switching position or the detection of the fluid pressures obtaining in the principal valve is desired, the respective principal valve will conveniently have an opening for access, which is open toward the diagnostic module, and which however is covered over by the respective diagnostic module so that externally there is no inconvenience. If the principal valves are directly provided with through ducts running in the row direction, one or more of such through ducts may be utilized as access opening for detection of states.

BRIEF DESCRIPTION OF THE DRAWINGS

In the following the invention will be described with reference to the accompanying drawings.

DESCRIPTION OF THE PREFERRED EMBODIMENTS

Figure 1:
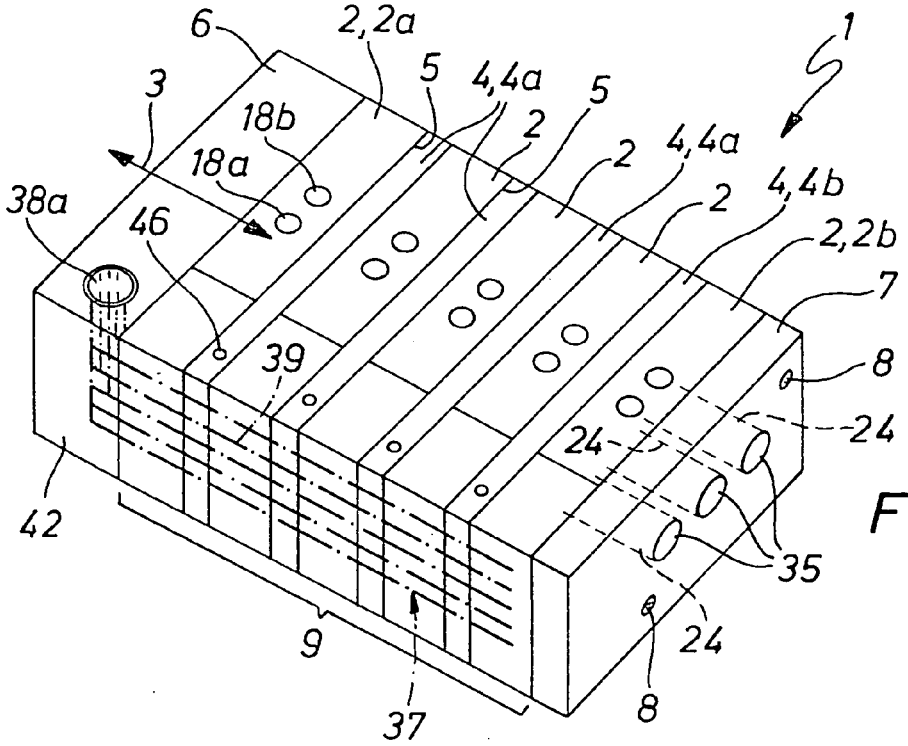
FIG. 1 shows a first working example of the fluid power controller device in accordance with the invention in a perspective and simultaneously diagrammatic view.
Figure 2:
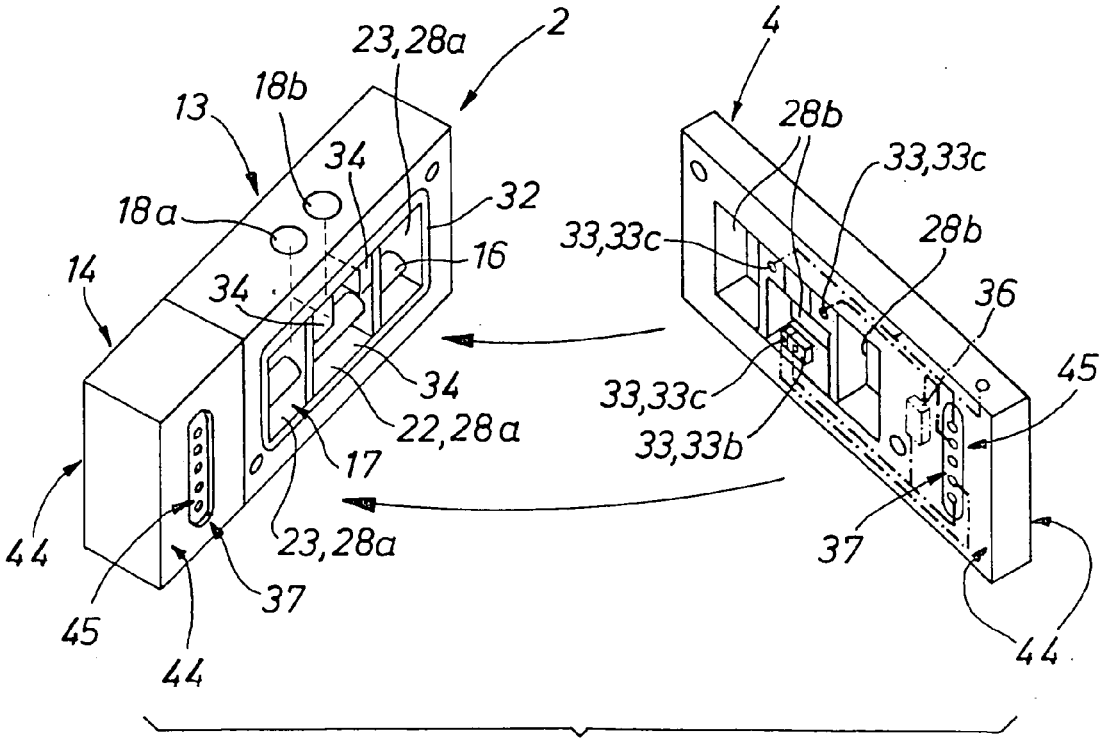
FIG. 2 is a separate perspective view of the valve module and a diagnostic module, to be secured thereto, of the controller device as in FIG. 1.
Figure 3:
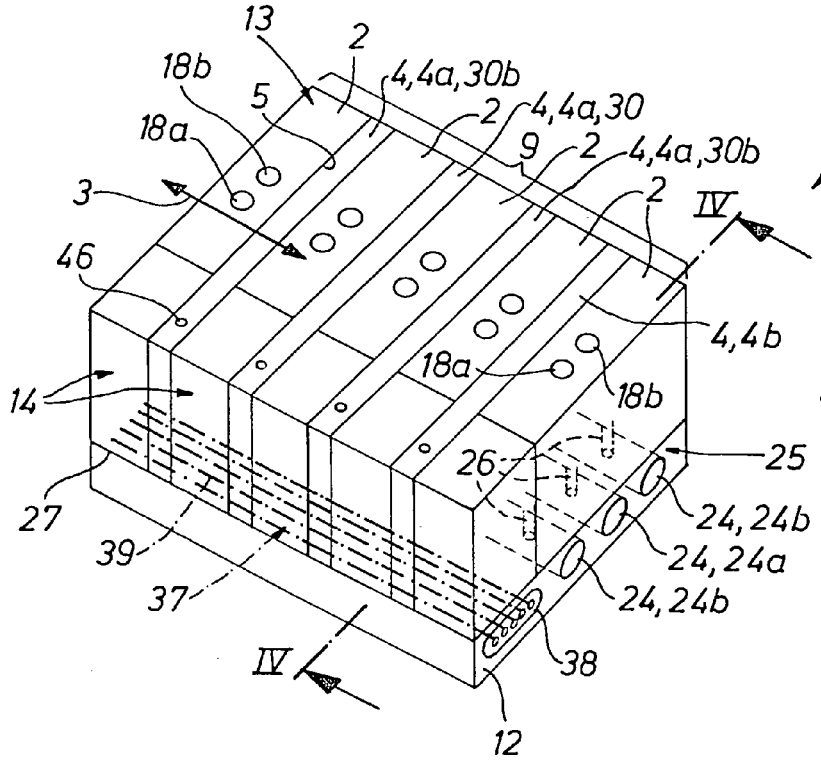
FIG. 3 shows a further design of the control module in accordance with the invention in perspective and diagrammatically.
Figure 4:
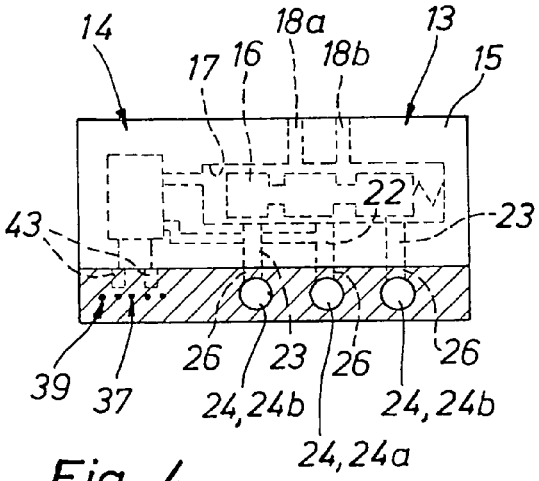
FIG. 4 is a cross section taken through the controller device of FIG. 3 in the transition zone between the a valve module and a diagnostic module, on the section line IV—IV.
Figure 5:
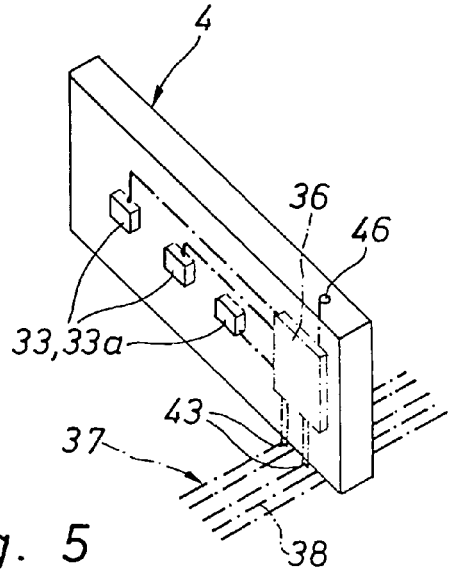
FIG. 5 is a perspective separate view of a diagnostic module as in the controller device of FIG. 3.

FIGS. 1 and 2 on the one hand and FIGS. 3 through 5 on the other hand show two different working examples of the fluid power controller device 1 in accordance with the invention, which is able to be employed for the operation of a machine, a group of machines or individual tools, the means to, be controlled being operated by fluid force, more particularly pneumatically. In case of need the controller devices 1 may be additionally provided with components, not depicted in detail, which render possible the operation of electrical instrumentalities.

The illustrated controller devices 1 have the feature in common that same comprise a plurality of valve modules 2, which are arranged in a row direction 3 indicated by a double arrow and are collected together as an array-like unit 9.

As further components of this array-like unit 9 there are several preferably disk-like or plate-like flat diagnostic modules 4, of which respectively one is placed between two valve modules 2 following each other in sequence in the row direction 3. In order to minimize the overall length of the controller device 1 the diagnostic modules 4 are so aligned that their planes of extent run at a right angle to the row direction 3.

Valve modules 2 which are directly adjacent in the row direction 3 are accordingly at a distance apart and define a gap-like intermediate space 5 between them, in which a respective diagnostic module 4 is seated.

In the case of the controller device 1 of FIG. 1 a respective terminal module 6 and 7 adjoins the two outer valve modules 2*a* and 2*b*. By means of ties 8 extending between the two terminal modules 6 and 7 the components of the unit 9 are firmly braced together in the row direction 3 so that the controller device 1 constitutes a self-supporting component group. Instead of the ties other mechanical connecting elements can be employed.

In the working embodiment illustrated in FIG. 3 the array-like unit 9 composed of the valve modules 2 and the diagnostic modules 4 is jointly seated on a rail- or plate-like module support 12. It is possible to collect together the components of the array-like unit 12 in a manner similar to FIG. 1 to provide a self-supporting structure unit and as such to secure it on the module support. However the structure illustrated is preferred, in which at least the valve modules 2 are individually secured to the module support 12. The diagnostic modules 2 can be respectively secured to one of the valve modules 2 flanking same and attached to the module support 12 by way of it, although there is also the possibility of providing an individual attachment of the diagnostic modules 4 on the module support 12 as an alternative or in a complementary manner.

Among other things FIGS. 2 and 4 indicate that the preferably block-like or plate-like valve modules 2 respectively comprise a principal valve 13 and an electrically operated valve drive 14 arranged on it. Dependent on the structural design it is also possible for several valve drives 14 to be arranged on the principal valve 13 and an integration in the principal valve 13 is also possible.

The valve drive 14 more particularly operates on an electromagnetic or piezoelectric basis. Its operation drives the principal valve 13, something which, more precisely stated, means that switching position of a valve member 16 movably mounted in the principal valve housing 15 is set in accordance with needs. In the case of the valve member 16 it is a question more particularly of a valve spool, preferably a piston spool. Its operation is preferably with a pilot function, the valve drive 14 being a component of a pilot valve, which is able to be subjected to a pilot fluid by means of the valve member 16 in order to set the switching position. The principal-valve 13 could also comprise several valve members.

The valve member 16 is located in a receiving space 17 in the interior of the principal valve housing 15. Two power ducts 18*a* and 18*b* communicate with this receiving space 16, which open at an external face, perpendicular to the means 3, of the principal valve housing 15 and which are able to be connected with fluid lines leading to a load to be operated, as for instance a drive operated by fluid power.

The receiving space 17 communicates furthermore with a supply duct 22 and at least one relief duct 23, two such relief ducts 23 being provided in the working example. By way of the supply duct 22 fluid under pressure is supplied, which in accordance with the switching position of the valve member 16 is passed into the one or other power duct 18*a* and 18*b*. The relief ducts 23 communicate with the atmosphere and serve for the return flow of the spent fluid from the connected load. If the controller device 1, as is the case with the working example, is operated with compressed air, the relief ducts 23 respectively constitute a venting duct.

In the case of both working examples central supply and removal of pressure medium to and, respectively, from the valve modules 2 is provided for. For this purpose in the working example in FIGS. 3 through 5 several fluid ducts 24 extend in the interior of the module support 12 in the row direction 3, which constitute a central supply duct 24*a* and two central removal ducts 24*b*. For the connection with a pressure source and for discharge into the atmosphere, for example by way of a muffler, the fluid ducts open at a connection face 25 of the module support 12.

Branch ducts 26 extend from the above mentioned fluid ducts 24, and open at the surface, termed the component mounting face 27, of the module support 12, on which the components of the array-like unit 9 are fixed. In this case the branch ducts 26 extending from the supply duct 24*a* communicate with the supply ducts 22 and the branch ducts 26 extending from the discharge ducts 24*b* communicate with the relief ducts 23 of the individual valve modules 2.

In the case of the controller device of FIGS. 1 and 2 the central fluid ducts extend at the level of the principal valves 13 indirectly through the array-like unit 9. In this case such central fluid ducts 24 are composed of mutually aligned through ducts 28*a* and 28*b*, which extend through the valve modules 2 and the diagnostic modules 4 in the row direction 3 and jointly constitute these central fluid ducts 24. In the case of the valve modules 2 the through ducts 28*a* simultaneously constitute the supply duct 22 and the relief ducts 23, that for their part are a component on the receiving space 17 so that the receiving space 17 containing the valve member 16 practically has the central fluid ducts 24 extending through it.

Sealing means 32 are arranged around the through ducts 28*a* and 28*b* opening at the two lateral faces of each valve module 2 and of the diagnostic module 4, such sealing means causing a sealing effect when the modules are braced in the row direction so that no fluid may leak out between adjacent fluid ducts into the surroundings.

Instead of having only one valve member 16 the principal valves 13 could, as already mentioned, each be provided with several valve members.

While the valve modules 2 of the working example are designed to distribute medium under a positive pressure, it would be feasible for it to be designed to distribute vacuum or negative pressure, it being possible for a vacuum producer to be directly integrated in the respective valve module 2. Inside a controller device 1 valve modules 2 for vacuum and positive pressure could be combined if necessary.

The diagnostic modules 4 are designed to detect at least one operational state of one or both principal valves 13, by which it is flanked on opposite sides. In the two working embodiments both possibilities are illustrated, three diagnostic modules 4*a* performing diagnosis on one side determining the operating states of only one adjacent principal valve 13, whereas a further diagnostic module 4*b* performs a diagnosis on two sides determining the operating state of both principal valves 3 flanking it.

If for each array-like unit 9 several diagnostic modules 4*b* are employed, the number of the diagnostic modules 4 to be utilized may be reduced, the overall length of the controller device 1 simultaneously being reduced because in this case it is possible to do without a separate diagnostic module 4 between one or more adjacent valve modules 2. In the example this could mean in accordance with FIG. 3 that the supplementary diagnostic module with the reference numeral 30*a* could be omitted, if the diagnostic modules with the reference numeral 30*b* are adapted for diagnosis on two sides.

In any case it is an advantage, if the diagnostic modules 4 have such an outline that they lie within the outline of the adjacent valve modules 2, this including the possibility of such outlines being identical.

There is also obviously the possibility of providing a diagnostic module 4 for only some of the principal valves 13. Within the controller device 1 it is accordingly possible for there to be principal valves 13 whose operational states are to be detected and also some not subject to such detection. Owing to the modular design the user has a great deal of free choice as regards the customization of the controller device 1.

To detect one or more operational states of a principal valve 13 the diagnostic modules 4 are fitted with sensor means 33, which are in a position to provide output sensor signals able to be further processed in accordance with the detected operational state.

FIG. 5 shows a diagnostic module 4 for example, which is fitted with sensor means 33, in the case of which it is a question of position sensor means 33*a*, using which one or more switching position of the valve member 16 of the relevant principal valve 13 may be detected. In the case of such position sensor means 33*a* it is a question for example of proximity sensors able to be activated without making contact, which respond to the valve member 16 or one or more actuating members arranged on it. It may more particularly be a question of inductive proximity sensors. The advantage of this type of position sensor means 33*a* is that same can detect the instantaneous position of the valve member 16 through the wall of the principal valve housing 15.

Other types of sensor means 33 require in addition to the diagnostic principal valve 13 at least one access opening 34, by way of which tapping of the desired state information is possible and which is open toward the associated diagnostic module 4 in order to perform sensor monitoring from this point. Such a design is depicted in FIG. 2. It will be seen that in this case means 33 are so arranged on the diagnostic module 4 that in the assembled state of the modules they respectively lie over one of the access openings 34.

Only by way of example in this connection further position sensor means 33*b* are provided in the diagnostic module 4 for optical detection of the switching state, such means 33*b* being in optical communication through an access opening with the valve member 16 thus being able to ascertain the switching state.

Furthermore a plurality of pressure sensor means 33*c* are present, which by way of the access openings communicate with zones in the interior of the principal valve 13, in which the supply pressure supplied by way of the supply duct 22 and/or the working pressure supplied by way of the working or power ducts 18*a* and 18*b* obtain.

Owing to the sensor detection of the switching state of the valve member 16 it is possible to exactly determine whether the principal valve has switched. Owing to the pressure detection comparable or relative detection is possible, but however it is also possible for any problems during pressure build-up—for instance owing to insufficient switching speeds—to be detected. Furthermore rates of flow within the principal valve 13 may be measured. In any case there is the possibility of a comprehensive functional diagnosis of the principal valves 13 of the valve modules 2 at any time during operation of the controller device 1.

As far as possible the access opening 34 may be in the form of one or more through ducts 28*a*, which are open toward the diagnostic module 4, of the principal valve guide 15. More especially for measuring the working pressure preferably however special access openings 34 are provided in the principal valve housing 15. In the case of operation without a diagnostic module 4 such access openings 34 are then closed by the adjoining valve module 2.

Normally the access openings 34 are sealed over by the associated diagnostic module 4 so that no spurious information is provided as regards the state data.

With respect to the controller device of FIGS. 1 and 2 it is to be noted that here the connection openings 35 for the central fluid ducts 24 are preferably located on one of the terminal modules 7 which covers the open side of the adjoining principal valve 13.

The diagnostic modules 4 may in principle be so designed that they have the sensor signals produced by the sensor means 33 as their direct output signal. However, a design is more expedient in which the diagnostic modules 4 comprise processing electronic circuitry 36, which evaluates the sensor signals received by the sensor means 33 to produce processed detection signals. In accordance with the type of sensor means 33 each diagnostic module 4 may be fitted with specifically suitable evaluating electronic circuitry 36.

For the supply of the actuating signals and actuating energy necessary for the operation of the valve modules 2 and for the return of the diagnostic signals from the diagnostic modules 4 all valve modules 2 and diagnostic modules 4 are preferably connected with a common electrical concatenation means 37. To the extent that for the operation of the diagnostic modules 4 actuating signals and/or energy are necessary, same may also be supplied by way of the common electrical concatenation means 37.

The electrical concatenation means 37 comprises a conductor strand 39 comprising a plurality of electrical conductors and extending in the row direction 3. It is connected on the one hand with the above mentioned modules 2 and 4. On the other hand in the case of the design in accordance with FIGS. 3 through 5 it leads to an electromechanical interface 38 arranged on the outer face of the module support 12, such interface being for example in the form of a plug device, by way of which a connection with further controller devices and/or an external electronic system is possible. It may in this case be a question of a bus connection.

FIGS. 1 and 2 illustrate that the electrical concatenation means 37 may on the one hand be connected with a central electronic control 42 located on board the controller device 1, such control 42 issuing actuating signals necessary for the operation of the valve modules 2. The central electronic control 42 is preferably a component of an independent module and in the working example is constituted by a terminal module 6. By way of an electromechanical interface 38*a* provided on this module in this case as well an electrical connection with external means is possible, more particularly with a master electronic control means. The electronic control 42 may in this connection possess an electronic field bus system.

Within the electrical concatenation means 37 the signal may be transmitted both in parallel and also more particularly serially. In the latter case at least the valve modules 2, and preferably however the diagnostic modules 4 as well, have electronic circuitry in a position of reading out the signals addressed to it and/or causing output of addressed signals coming from it into the electrical concatenation means 37.

In the working embodiment illustrated in FIGS. 3 through 5 the conductor strand 39 extends in the module support 12. At the valve modules 2 and at the diagnostic modules 4 contact elements 43 are provided, which during the installation of the respective module on the module support 12 come into contact with the correctly corresponding conductor strand 39. The contact elements 43 may be designed for the production of plain pressure-loaded contacts or however for the production of a plug contact.

In the case of the controller device of FIGS. 1 and 2 the conductor strand 39 extends through the array-like unit 9. To this extent the conductor strand 39 is composed of individual conductor strand elements, which extend through the respective module 2 and 4 and are connected with interfaces 45 two opposite arranged on Joint faces 44 orientated in the row direction 3. In the assembled condition of the array-like unit 9 the mutually facing interfaces 45 of adjacent modules 2 and 4 are electrically connected and accordingly constitute the electrical conductor strand 39.

Finally it is to be noted that one or more diagnostic modules 4 may be directly fitted with condition indicating means 46, which are in a position of indicating one or more detected operational states, more particularly in an optical manner. In the case of the condition indicating means 46 it may more especially be a question of LEDs.

If the diagnostic modules 4 do not have any evaluating electronic circuitry of their own, output of the sensor signals generated by the sensor means 33 may obviously be by way of the electrical concatenation means 37.

What is claimed is:

1. A fluid power controller device comprising valve modules arranged in sequence in a row direction and collected together as an array-like unit, such modules each including a principal valve fitted with at least one moving valve member and at least one electrically operated valve drive for the principal valve, characterized in that at least two valve modules placed in sequence in the row direction are spaced apart with the formation of an intermediate space, a diagnostic module being placed in the intermediate space for the detection of at least one operational state of one or both of the adjacent principal valves.

2. The controller device as set forth in claim 1, wherein between all sequentially following modules a respective diagnostic module is arranged.

3. The controller device as set forth in claim 1, wherein between sequentially following valve modules in alternate succession in one case a diagnostic module for diagnosis of the two respective adjacent principal valves and in the other case no diagnostic module is provided.

4. The controller device as set forth in claim 1, wherein the diagnostic module does extend past the outline of the respectively adjacent valve module.

5. The controller device as set forth in claim 1, wherein the valve modules and the diagnostic module or modules are connected with a joint electrical concatenation means, which leads to a central electronic control located on board the controller device and/or to an electromechanical interface, more especially a plug means.

6. The controller device as set forth in claim 1, wherein the valve modules and the at least one diagnostic module are collected together by a mechanical connection, as for example by means of ties, to constitute a self-supporting assembly.

7. The controller device as set forth in claim 1, wherein for the central supply and/or removal of pressure medium to and, respectively, from the valve modules at least one fluid duct is present extending through all valve modules and diagnostic modules in the row direction, such fluid duct being composed of aligned ducts of the valve modules and of the diagnostic modules, adjacent valve and diagnostic modules being placed together in a sealing manner.

8. The controller device as set forth in claim 1, wherein the valve modules and the at least one diagnostic module are seated on a rail-like or plate-like module support, in which there extends at least one fluid duct provided for the central supply and/or removal of pressure medium to and, respectively, from the valve modules.

9. The controller device as set forth in claim 1, wherein at least one diagnostic module is designed in a disk-like or plate-like form.

10. The controller device as set forth in claim 1, wherein at least one diagnostic module for detection of the at least one operational condition of the principal valve to be diagnosed is provided with sensor means adapted for the output sensor signals.

11. A fluid power controller device comprising valve modules arranged in sequence in a row direction and collected together as an array-like unit, such modules each including a principal valve fitted with at least one moving valve member and at least one electrically operated valve drive for the principal valve, characterized in that at least two valve modules placed in sequence in the row direction being spaced apart with the formation of an intermediate space, a diagnostic module being placed in the intermediate space for the detection of at least one operational state of one or both of the adjacent principal valves, wherein the at least one diagnostic module possesses position sensor means for the detection of one or more switching positions of the valve member of at least one adjacent principal valve.

12. The controller device as set forth in claim 11, wherein the position sensor means possesses proximity sensors able to be activated without contact and more particularly sensors of an inductive type.

13. The controller device as set forth in claim 11 wherein the position sensor means are designed for optical switching position detection.

14. The controller device as set forth in claim 10, wherein at least one diagnostic module possesses pressure sensor means for the detection of one or more fluid pressures obtaining in at least one adjacent principal valve.

15. The controller device as set forth in claim 14, wherein the pressure sensor means are adapted for the detection of the supply pressure in the respective principal valve and/or at least one working pressure.

16. The controller device as set forth in claim 10, wherein the principal valve to be diagnosed comprises at least one access opening rendering possible access by the sensor means for desired state information, such opening being open toward the diagnostic module and being covered by the respective diagnostic module.

17. The controller device as set forth in claim 10, wherein at least one diagnostic module possesses evaluating electronic circuitry for the sensor signals supplied by the sensor means.

18. The controller device as set forth in claim 1, wherein at least one diagnostic module possesses state indicating means, more particularly optical indicating means.

* * * * *